US006033733A

United States Patent [19]

Samoil et al.

[11] Patent Number: 6,033,733

[45] Date of Patent: Mar. 7, 2000

[54] METHOD FOR CONTROLLING DENTIFRICE USAGE

[75] Inventors: Grace Samoil, North Brunswick; Daniel Colodney, Hampton; Carmen Yolanda Bonta, Somerset, all of N.J.

[73] Assignee: Colgate-Palmolive Company, New York, N.Y.

[21] Appl. No.: 08/417,419

[22] Filed: Apr. 5, 1995

Related U.S. Application Data

[62] Division of application No. 07/934,139, Aug. 3, 1992, Pat. No. 5,240,926.

[51] Int. Cl.[7] ..... B05D 1/26

[52] U.S. Cl. ..... 427/256

[58] Field of Search ..... 222/154, 158; 427/256

[56] References Cited

U.S. PATENT DOCUMENTS

| | | | |
|---|---|---|---|
| 2,262,982 | 11/1941 | Wolcott | 15/167.1 |
| 2,312,828 | 3/1943 | Adamsson | 15/167.1 |
| 2,795,043 | 6/1957 | Fleischer | 222/158 |
| 2,946,072 | 7/1960 | Filler | 15/167.1 |
| 3,072,944 | 1/1963 | Clayton et al. | 15/167 |
| 3,188,673 | 6/1965 | Newman | 15/167 |
| 3,302,230 | 2/1967 | Poppelman | 15/104.94 |
| 4,403,623 | 9/1983 | Mark | 132/84 |
| 4,490,875 | 1/1985 | Grunz | 15/143 |
| 4,802,255 | 2/1989 | Breuer et al. | 15/159 |
| 4,861,179 | 8/1989 | Schrepf et al. | 15/206 |

FOREIGN PATENT DOCUMENTS

| | | | |
|---|---|---|---|
| 0557790 | 5/1923 | France . | |
| 0618049 | 3/1927 | France . | |
| 1203916 | 8/1959 | France . | |
| 1233465 | 10/1960 | France | 15/167.1 |
| 0891114 | 3/1962 | United Kingdom | 15/167.1 |

*Primary Examiner*—Fred J. Parker
*Attorney, Agent, or Firm*—Michael McGreal

[57] ABSTRACT

There is provided a toothbrush where the dose of dentifrice used is controlled by the use of bristles of at least two different colors. When the bristles of one color are covered with a dentifrice the dose will be within guidelines. In addition, the dentifrice and bristles of one of the colors can be the same to aid in controlling the dose of dentifrice. This will in turn limit the dose of fluoride and other components of a dentifrice.

17 Claims, 2 Drawing Sheets

METHOD FOR CONTROLLING DENTIFRICE USAGE

This is a Division of application Ser. No. 07/934,139 filed Aug. 3, 1992 now U.S. Pat. No. 5,240,926.

BACKGROUND OF THE INVENTION

The present invention is directed to a toothbrush where the bristles are in a pattern to regulate the dose of dentifrice being used. More particularly, this invention is directed to a toothbrush having bristles of at least two colors whereby the bristles of one of the colors serve to regulate the dose of dentifrice being used.

There are instances where it is desired to limit the amount of dentifrice that is used for any one brushing. This is particularly the case with children. Children in many instances will not expel the dentifrice after brushing but rather will swallow the dentifrice. In such an instance they are ingesting amounts of fluoride and other components that preferably should not be ingested by children. The objective in the present invention is to provide a toothbrush which has a coded bristle pattern. This coded bristle pattern is such that when the coded bristle pattern is coated with a paste extruded from a standard tube or pump that a dose of about 0.1 to 0.75 grams is deposited on the bristles. The coded bristles are a guide as to how much dentifrice to use for a brushing. The coding of the brush is by having tufts of bristles of at least two different colors. The dentifrice is only placed on bristles of a particular color.

There are brushes that have a multi-color bristle pattern. However, there are no toothbrushes where the bristles are color coded so as to regulate the dose of dentifrice that is used. In various prior art toothbrushes the bristles are of different colors for decorative purposes, to serve as an indicator when the brush should be changed, or to instruct as to proper brushing techniques. U.S. Pat. No. 3,188,673 discloses a toothbrush that has different color bristles in order to instruct children the proper brushing techniques. In this patent there is shown the use of blue and white bristles or green and white bristles. In U.S. Pat. No. 4,403,623 the bristles appear to be of two different colors. In this instance the bristles of one color are softer than the bristles of another color. In U.S. Pat. No. 4,403,623 the bristles appear to be of two different colors. In this instance the bristles of one color are softer than the bristles of another color. In U.S. Pat. No. 4,802,255 there is shown a brush where some of the bristles have a dye that has penetrated part of the distance through the bristle. During usage this dye is gradually dissipated with the effect that when the dye is almost fully lost from the bristles that this is time to replace the brush.

These patents are illustrative of the prior art. Commercially available toothbrushes use bristles of two different colors for ornamental purposes. This is the case with versions of the Colgate Plus toothbrushes for use by persons with sensitive gums.

BRIEF SUMMARY OF THE INVENTION

This invention is directed to a color coded toothbrush that is designed to instruct as to the proper dose of dentifrice to use for a brushing. The toothbrush has bristles of at least two different colors. The bristles of a first color are in a number such that when a dentifrice is deposited only on these colored bristles of the toothbrush the person will be using only about 0.1 grams to about 0.75 grams of dentifrice, and preferably about 0.1 grams to about 0.4 grams of dentifrice. The amount will depend to a large degree on the end surface area of the tufts bristles onto which the dentifrice is to be deposited. Each tuft usually will be comprised of the same color bristles. The tufts of bristles, onto which the dentifrice can be coated, can be arranged in any shape on the brush head. This can be a circular area, star shaped area, or in the shape of an animal or the like. The required feature is that there be a correlation between the number of colored tufts and the amount of dentifrice that can be placed on these tufts when a dentifrice is extruded from a tube or pump. This is particularly useful in training children on the proper dose of a dentifrice to be used for a brushing.

DETAILED DESCRIPTION OF THE INVENTION

As has been noted, this development is directed to a toothbrush which has different color tufts to instruct a person with regard to how much dentifrice to use for a brushing. This is very useful for young children through teenagers. Children tend to use excessive amounts of dentifrice for a brushing. Also, since many children's dentifrices are flavored with very acceptable tastes, there is a tendency for children to ingest the dentifrice after brushing. This is not desirable due to the fluoride content of the dentifrice. There also are other components that should not be ingested.

Figure 1:
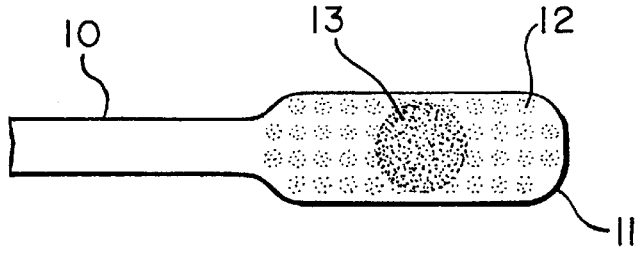
FIG. 1 is a top plan view which shows a toothbrush having bristles of a first color in a circular pattern and the remaining bristles being of a second color.

There is shown in FIG. 1 a toothbrush having a handle 10 and head portion 11 which supports bristles 12 and 13. The bristles are inserted into the head portion in tufts. Tufts are groupings of bristle filaments. A bristle tuft will contain from about 20 to 75 filament ends. A toothbrush head will contain from about 20 to 60 tufts depending on the size of the brush. The bristles 13 in FIG. 1 are of a first color and are shown here to be in a circular pattern. This circular pattern is of a size to hold about 0.1 to 0.75 grams of dentifrice, and preferably about 0.1 to 0.4 grams. In one preferred embodiment the color of the tufts of bristles 13 is the same as the dentifrice to be applied to the bristles. In a second preferred embodiment the tufts of bristles 12 are the same color as the dentifrice to be applied to the bristles. In either case the coloration of the paste and bristles gives an indication of the amount of dentifrice to be deposited onto the brush. Where the dentifrice is the same color as the bristles 13 the dentifrice would be deposited to only cover the same colored bristles. In the latter preferred embodiment where the bristles 12 are the same color as the dentifrice, the dentifrice would be deposited to cover the bristles 13 of a different color to provide bristles of all the same color since the differently colored bristles are now coated with the dentifrice of the same color.

Figure 2:
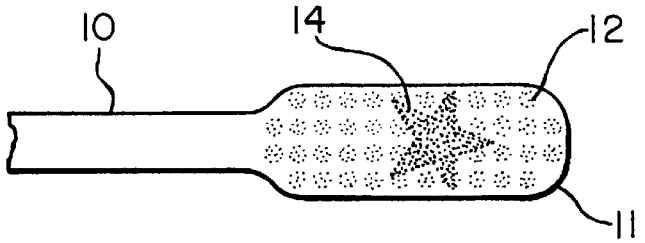
FIG. 2 is a top plan view which shows a toothbrush having bristles of a first color in a star shaped pattern.
Figure 3:
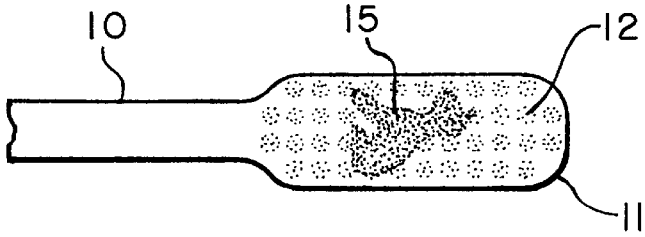
FIG. 3 is a top plan view which shows a toothbrush having bristles of a first color in the design of an animal.

FIG. 2 shows an embodiment similar to that of FIG. 1 but where the bristles of a first color are in the form of a star 14. In FIG. 3 there is shown a similar toothbrush but with bristles of a first color in the form of an animal 15.

Figure 4:
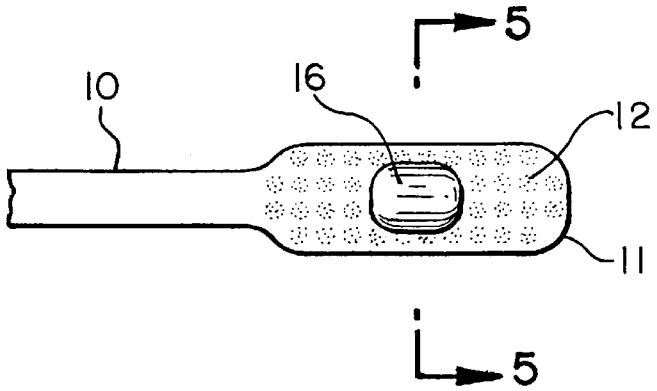
FIG. 4 is a top plan view which shows the toothbrush of FIG. 1 with a dose of dentifrice of a first color on the bristles of a first color.
Figure 5:
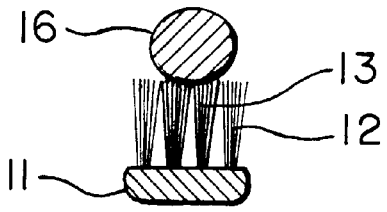
FIG. 5 is a cross-sectional view of the toothbrush of FIG. 4 along line 5—5.

In FIG. 4 there is shown the toothbrush of FIG. 1 with a deposit of dentifrice 16 of a first color covering tufts 13 that are of the first color. This is shown in cross-section in FIG. 5. In this embodiment the bristles that are to carry the dentifrice are of the same color as the dentifrice.

Figure 6:
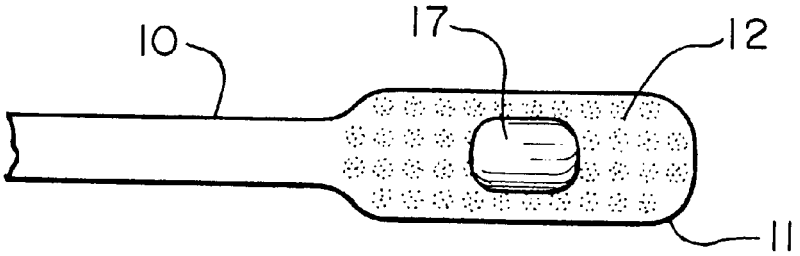
FIG. 6 is a top plan view of the toothbrush of FIG. 1 with a dose of dentifrice of second color on bristles of a first color.

FIG. 6 shows the toothbrush of FIG. 1 with a dentifrice 17 of the same color as bristles 12. The result when there has been a proper dose of dentifrice applied to the brush is a single color pattern to the top of the toothbrush bristles.

As has been noted it is desired to limit the ingestion by children of some components of dentifrices, one of the components being fluoride. Dentifrices will contain from about 600 to 1,600 ppm and usually about 1,000 to 1,200 ppm of fluoride as sodium fluoride, stannous fluoride or sodium monofluorophosphate. There are yet other components of dentifrices that should not be ingested in any significant amounts by children.

Figure 7:
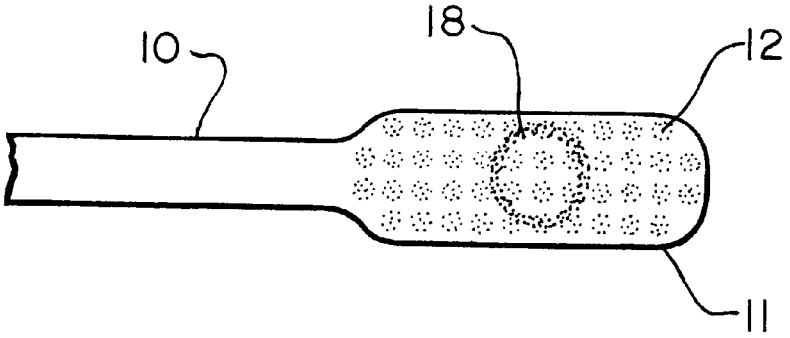
FIG. 7 is a top plan view of a toothbrush where the bristles on the perimeter of a design are different in color from the remainder of the bristles.

A further embodiment is illustrated in FIG. 7 where there is shown bristles 12 of brush 10 being of one color while bristles 18 which outline the perimeter of design are of a different color. In FIG. 7 the perimeter bristles 18 are in the form of a ring with the bristles 12 inside and outside of the ring being of a different color from bristles 18 that form the ring. This embodiment of the perimeter bristles being of a different color from the remainder of the bristles can be applied to any design, including those described in the figures of this application. In this embodiment the dentifrice would be put on the bristles within the ring.

This present toothbrush will teach children the proper dosage of dentifrice to use for each brushing. The placing of the dosage on the bristles will also provide a fun activity. The dentifrice will be carefully extruded until the particular colored bristles are covered with a dentifrice. The information of the proper dose of dentifrice to use will be useful throughout life.

What we claim is:

1. A method of controlling the dose of dentifrice used for a brushing comprising providing a toothbrush wherein the bristles are comprised of at least two different colors and wherein the bristles of one color provide a pattern such that when the bristles of said pattern support a dose of dentifrice deposited thereon the dose is from about 0.1 to 0.75 grams of dentifrice, and depositing a dose of dentifrice onto said bristles of said pattern to substantially cover said bristles of said pattern and to deposit a dose of dentifrice of about 0.1 to about 0.75 grams thereon.

2. A method as in claim 1 wherein said dentifrice is the same one color as the bristles of said one color.

3. A method as in claim 1 wherein said dentifrice is the same color as bristles that are not of said one color.

4. A method as in claim 1 wherein the bristles of said one color form a circular pattern.

5. A method as in claim 1 wherein the bristles of said one color form a star pattern.

6. A method as in claim 1 wherein the bristles of said one color form an animal shaped pattern.

7. A method as in claim 1 wherein the dose of dentifrice is from about 0.1 gram to about 0.4 grams.

8. A method of controlling the dose of dentifrice used for brushing teeth comprising providing a toothbrush wherein the bristles are comprised of at least two different colors and wherein the bristles of one color provide a pattern such that when the bristles of said pattern support a dose of dentifrice of the same one color there is deposited on said bristles of one color a dose of dentifrice of about 0.1 to about 0.75 grams, and depositing a dose of dentifrice on said bristles of one color to substantially cover said bristles of one color and deposit a dose of dentifrice of about 0.1 to about 0.75 grams thereon.

9. A method as in claim 8 wherein the dose of dentifrice is from about 0.1 grams to about 0.4 grams.

10. A method as in claim 8 wherein the bristles of said one color form a circular pattern.

11. A method as in claim 8 wherein said bristles of said one color form a star pattern.

12. A method as in claim 8 wherein said bristles of said one color form an animal shape pattern.

13. A method of controlling the dose of dentifrice used for brushing teeth comprising providing a toothbrush wherein the bristles are comprised of at least two different colors and whereby the bristles of one color provide a pattern such that when the bristles of said one color support a dose of dentifrice of the color of the bristles not of said one color to cover the bristles of said one color the dose of dentifrice deposited thereon is from about 0.1 grams to about 0.75 grams, and depositing said dose of dentifrice on said bristles of said pattern to substantially cover said bristles of said pattern and deposit a dose of dentifrice of about 0.1 to about 0.75 grams thereon.

14. A method as in claim 13 wherein the dose of dentifrice is from about 0.1 grams to about 0.4 grams.

15. A method as in claim 13 wherein the bristles of said one color form a circular pattern.

16. A method as in claim 13 wherein said bristles of said one color form a star pattern.

17. A method as in claim 13 wherein said bristles of said one color form an animal shaped pattern.

* * * * *